United States Patent [19]

Sammons

[11] Patent Number: 5,039,103

[45] Date of Patent: Aug. 13, 1991

[54] GOLF GAME APPARATUS

[76] Inventor: Charles H. Sammons, 804 Colleton Rd., Raleigh, N.C. 27610

[21] Appl. No.: 641,874

[22] Filed: Jan. 4, 1991

[51] Int. Cl.[5] ..... A63B 69/36

[52] U.S. Cl. ..... 273/176 F; 273/178 R

[58] Field of Search ..... 273/176 F, 176 FA, 176 FB, 273/178 R, 178 A, 187 B, 176 B, 177 R, 177 A, 177 B

[56] References Cited

U.S. PATENT DOCUMENTS 1,295,437 2/1919 Cogswell ..... 273/177 A 2,719,719 10/1955 Sherwan ..... 273/177 R 2,737,392 3/1956 Stokes ..... 273/177 A 3,342,494 9/1967 Talley ..... 273/177 R X

*Primary Examiner*—George J. Marlo

*Attorney, Agent, or Firm*—Olive & Olive

[57] ABSTRACT

A golf game wherein players attempt to putt their balls into a generally rectangular goal cup placed at each end of a linear mat. The goal cups preferably have a curved roof to deflect balls and have padding on the inside back and bottom of the cups. Angled barrier pieces are provided at each side of the goal cups. The mat is held flat at each end with a strip of wood.

8 Claims, 4 Drawing Sheets

FIG. 4
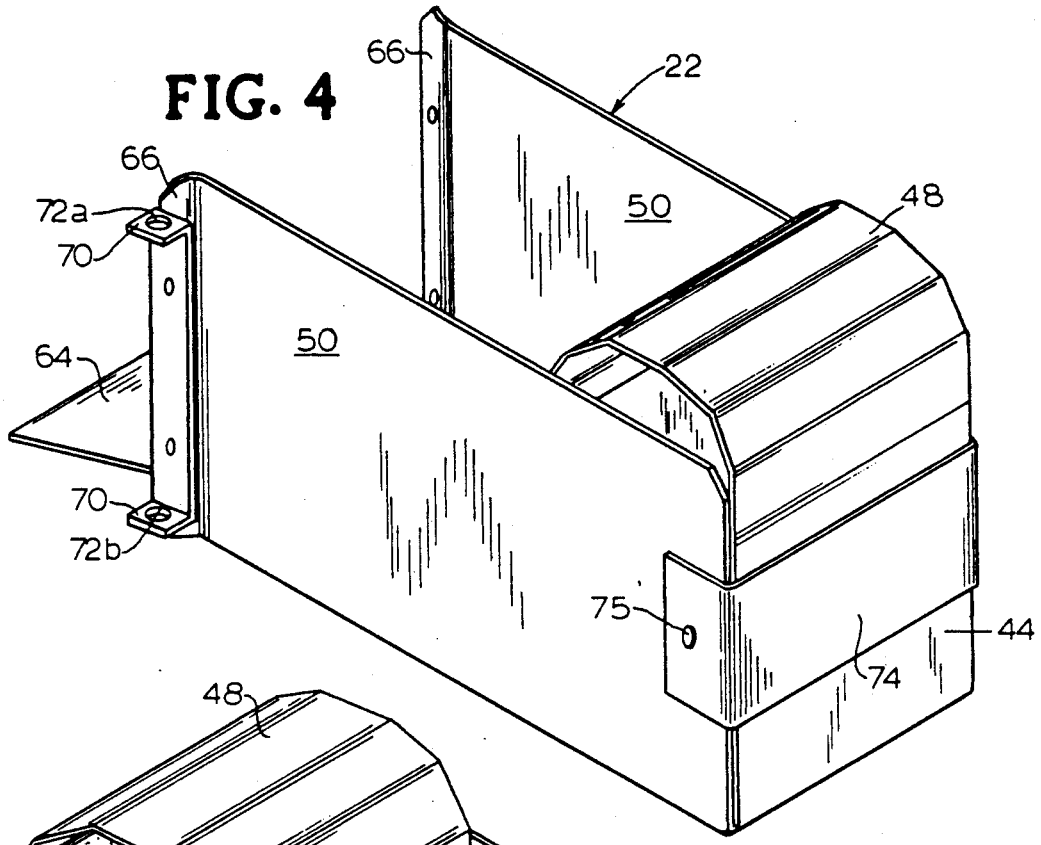
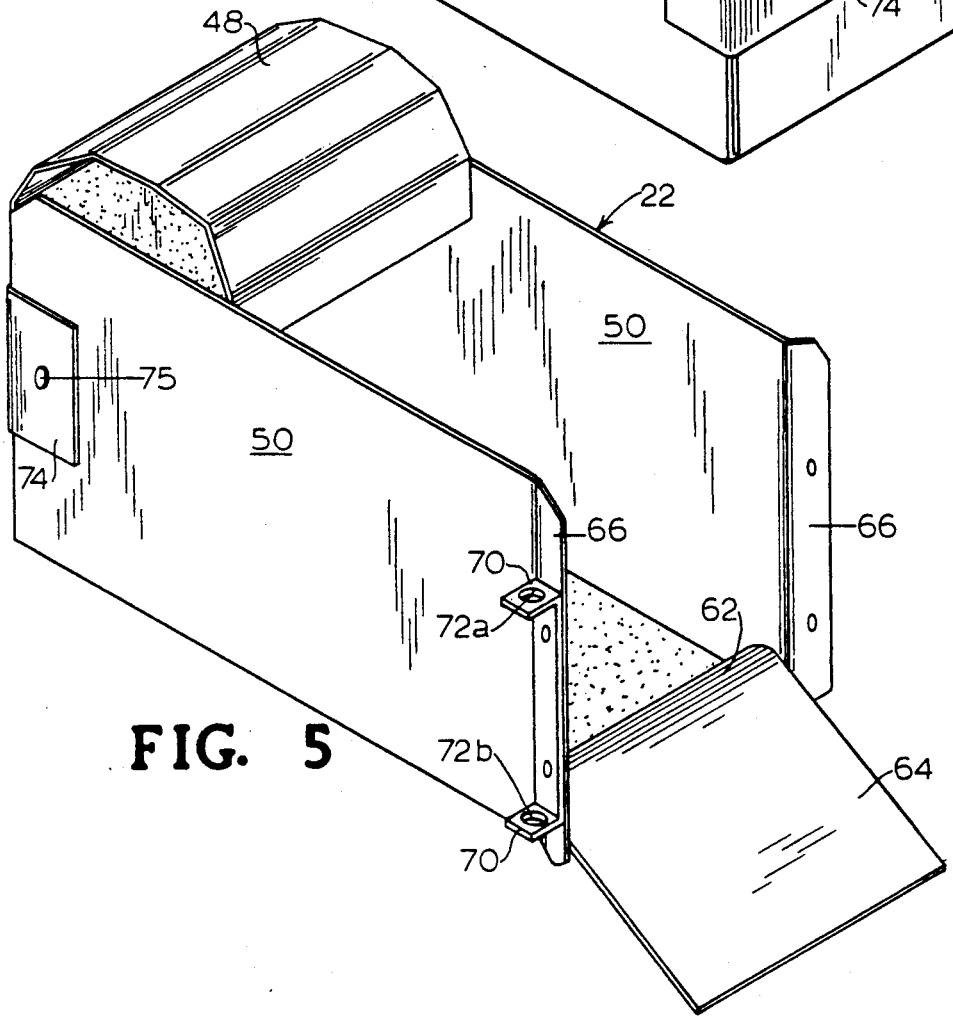
FIG. 5

GOLF GAME APPARATUS

BACKGROUND OF THE INVENTION

1. Field of the Invention

This invention relates to the game of golf, and in particular, relates to a game utilizing a standard golf club and ball. The game may be played indoors or outside and may be used to practice golf swings.

2. Description of the Related Art

Numerous indoor or miniature golf games have been devised to allow golfers to play golf-like games without driving to a golf course or even leaving the office. Many of these games also allow golfers to practice their swings in a manner quite similar to actual golfing, but others are similar to golf primarily in their use of holes, uneven terrain, and other structural features.

In an attempt to simulate actual outdoor golf courses, various indoor golf games provide a variety of different types of simulated holes in the ground. For example, the patent of Shusda (U.S. Pat. No. 3,341,207) has an inclined platform with a circular concave target portion at its elevated end and a chute leading from the concave target portion. The putting device of Robinette (U.S. Pat. No. 3,351,345) also has a cup element having an inclined approach and a regress surface around it. The target of Travers (U.S. Pat. No. 3,434,721) has a dome-shaped upper surface with scoring depressions and a putting hole.

Various golf-ball cups and receptacles exist for use above a surface in simulated golf-type games. For example, see the inventions of Ganger (U.S. Pat. No. 3,341,206) which has a flat circular base and wedge means to keep the ball from rolling out; Trimble (U.S. Pat. No. 3,451,682) which is a frustoconical polygon with ramp edges which tips from its side to an upright position when it receives a ball; Dahlberg (U.S. Pat. No. 3,484,109) comprising a tilted frusto-conical dish on a tripod; Furnari (U.S. Pat. No. 3,652,095) which is a cylinder with one open end for receiving the ball being anchored by a post; and Gubany (U.S. Patent No. 4,878,671) which is a circular cup with a resilient frusto-conical flange anchored by a flagpole placed through a central hole in the cup.

In order to contain all their components and to simulate an actual golf course, many of the golf games provide very elaborate, large simulated courses which may require substantial space or must be placed outdoors. For example, one golf game includes an inclined surface in conjunction with conduits leading from ball receiving compartments (U.S. Pat. No. 3,424,463). Many of the golf courses are also bulky and difficult to transport or set up. Thus, the golf game device of Baum (U.S. Pat. No. 3,715,123) has a peripheral wall with a rail around it.

In many golf games, it may be difficult to get the ball in the hole, or alternatively, it may be easy to get the ball in the holes, but difficult to hit the ball so that the ball stays in a hole. Others provide means of holding a ball in the hole, for example, or of keeping the ball from striking the golfer (U.S. Pat. No, 3,524,649).

Many of the restricted area golf games do not provide means for keeping the ball from rolling away from the playing area. Others have various designs of walls, for example, an arcuately-configured wall (U.S. Pat. No. 4,124,210); or a ball retainer which grasps the edge of a putting mat material (U.S. Pat. No. 4,966,370).

There are also a number of golf mats and putting carpets (e.g., U.S. Design Pat. Nos. 252,048; 267,417; 307,618; and U.S. Pat. No. 4,850,594) and indoor/outdoor practice targets (e.g., U.S. Design Pat. Nos. 261,295; 261,791; and 273,126). The mats may be provided with a variety of cups, for example, rotatable cups having a ball inlet slot in their side walls (U.S Pat. No. 3,464,704); cup-like elements having releasable elements which pivot out of the way for speeding balls (U.S. Pat. No. 3,801,107); and cups insertable into openings of a mat with transverse lines on it (U.S. Pat. No. 3,843,136).

It is therefore an object of this invention to provide a golf game which has components which are inexpensive and simple to produce.

It is a further object of this invention to provide a golf game where the playing area is flat and the goal cups are on top of the playing area.

It is a further object of this invention to a golf game which may be played both indoors and outdoors in a limited area, and which has components which may be easily transported from place to place.

It is a further object of this invention to provide a golf game having means for keeping the ball from rolling out of the hole or off of the playing area.

Other objects and advantages will be more fully apparent from the following disclosure and appended claims.

SUMMARY OF THE INVENTION

The golf game apparatus of the invention to be played with a golf club and ball, comprises:

(a) a linear mat having a first and a second end;

(b) a plurality of goal cups, each goal cup having generally rectangular sides, said goal cups positioned at each of said ends, each of said goal cups having an opening facing the other goal cup, each of said goal cups comprising:

(i) two sides;

(ii) a lower floor;

(iii) a curved upper cover; and (iv) a back side;

(c) a plurality of barrier pieces, said barrier pieces attached to a side of the goal cup to prevent the ball from rolling away from said mat;

(d) a putting line located at each end between the goal cups; and (e) a scoring line at each end, said scoring line, barrier pieces and goal cup defining a scoring area at each end.

The golf game of the invention is played by putting balls back and forth and scoring the final location of the balls according to the rules.

The game pieces of the invention may be used, and the game of the invention played, inside or outside, at dens, offices, rest homes, schools, driveways, garages, on low-cut lawns, and the like.

Other aspects and features of the invention will be more fully apparent from the following disclosure and appended claims.

BRIEF DESCRIPTION OF THE DRAWINGS

FIG. 4 is a side perspective view of a goal cup of the invention.

FIG. 5 is a front perspective view of a goal cup of the invention.

DETAILED DESCRIPTION OF THE INVENTION AND PREFERRED EMBODIMENTS THEREOF

Figure 1:
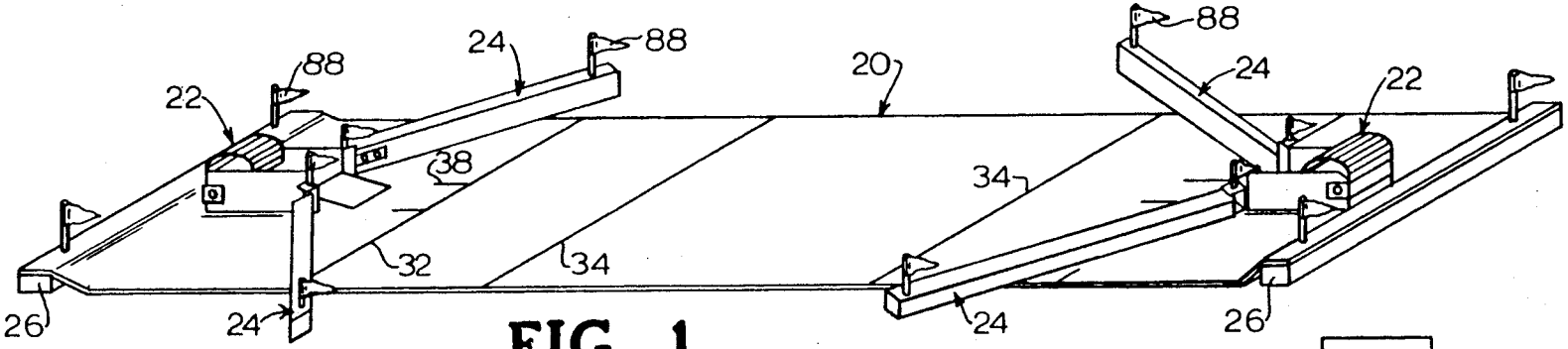
FIG. 1 is perspective view of the components of the golf game of the invention.

The present invention comprises a linear putting green mat 20, two goal cups 22, and two barrier pieces 24 for each goal cup 22 (FIG. 1).

Figure 2:
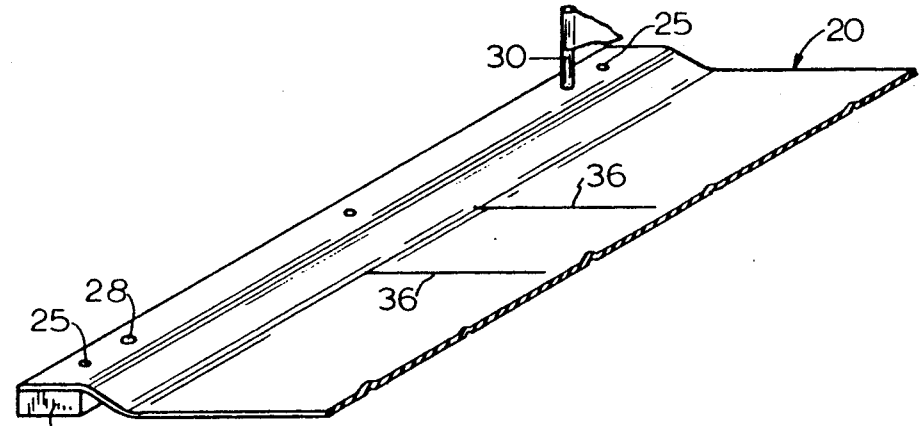
FIG. 2 is a perspective side view of the end of a mat with one spike in place.

The mat 20 is preferably made of green grass-simulating, indoor-outdoor carpet runner material. Preferably, the mat 20 is made of a piece of material about 16 feet by 27 inches in size. Each end of the mat 20 is attached, for example, by means of nails 25, staples or glue, to a long sturdy strip 26 the width of the mat (FIG. 2). The strips 26 are preferably made of wood and serve to keep the mat 20 flat at the ends. Two holes 28 are provided in each wood strip 26 so that large spikes may be driven through the strip 26 to hold it to the ground for outdoor play. These holes 28 are not used for indoor play.

The following markings are preferably placed on each end of the mat as shown in FIG. 1, for example, with a marking pen:

(a) a score line 32 perpendicular to the lengthwise axis of the mat 20 and about 18–20 inches from the end of the mat 20;

(b) a putt line 34 perpendicular to the lengthwise axis of the mat 20 and about 30–32 inches from the end of the mat 20 (12 inches from the score line so that there is a distance of about 12 feet between putting lines);

(c) cup location lines 36 perpendicular to and abutting the wood strip 26 at each end for placement of the cup 22 during play; and (d) optionally, additional guide lines 38 extending toward the cup 22 from the score line 32 to aid in putting.

Figure 3:
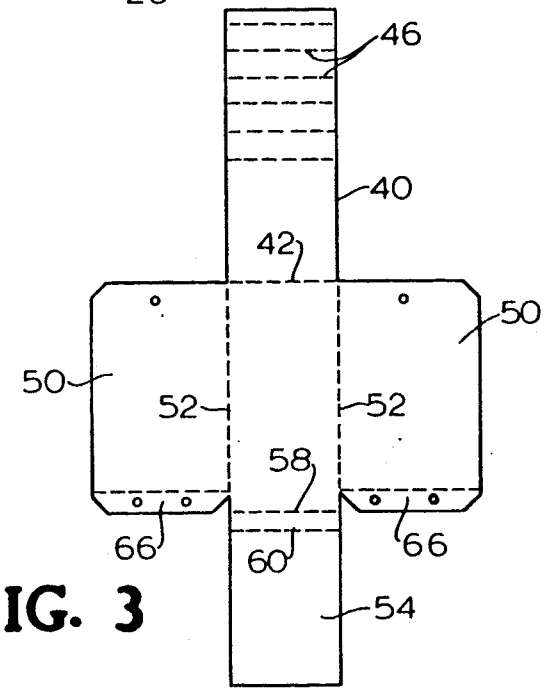
FIG. 3 is a plan view of a piece of material that may be used to make a one-piece goal cup of the invention.

The goal cups 22 (FIGS. 1,3–5) are preferably generally rectangular boxes which may be cut from metal, such as 18 gauge steel, but also may be made of wood, molded plastic, or other sturdy material. When cut from a material such as steel, a cross-shape such as that shown in FIG. 3 may be used. The dotted lines show areas where the material is folded. Elongated portion 40 is folded in a right angle fold at line 42 to form the back 44 of the cup 22, and in slight folds at lines 46 or is rounded across the area of lines 46 to form a gently rounded cover 48 for the cup 22. Side pieces 50 are folded up at lines 52 to form the sides of the cup. Ramp piece 54 is folded in toward the bottom 56 of the cup 22 at line 58 and back out away from the bottom 56 of the cup 22 at line 60, so that it forms a sill 62 above the bottom 56 of the cup 22 and then slants downward away from the cup 22 to form a ramp 64 sloping down from the cup 22 to the mat 20. Edges 66 are angled back out of the box and attached to an anchor piece 68 by welding, bolts, or pop rivets. Anchor piece 68 is preferably a flat elongated piece of steel or other metal with a bend 70 and an anchor hole 72 at each end.

Bracket piece 74 (FIG. 4) is placed across the outside back 44 of the cup 22 and attached to the sides 50 of the cup by means of any type of metal fasteners 75 such as pop rivets to hold the back and sides together. Preferably pieces of foam or sponge 76 are placed on the bottom and back of the inside of the goal cup 22 to provide a cushion and to reduce the noise of impact of the ball in the goal cup. The finished size of the goal cup 22 is preferably about 4–5 inches high, 7–8 inches long and 4–5 inches wide.

Figure 6:
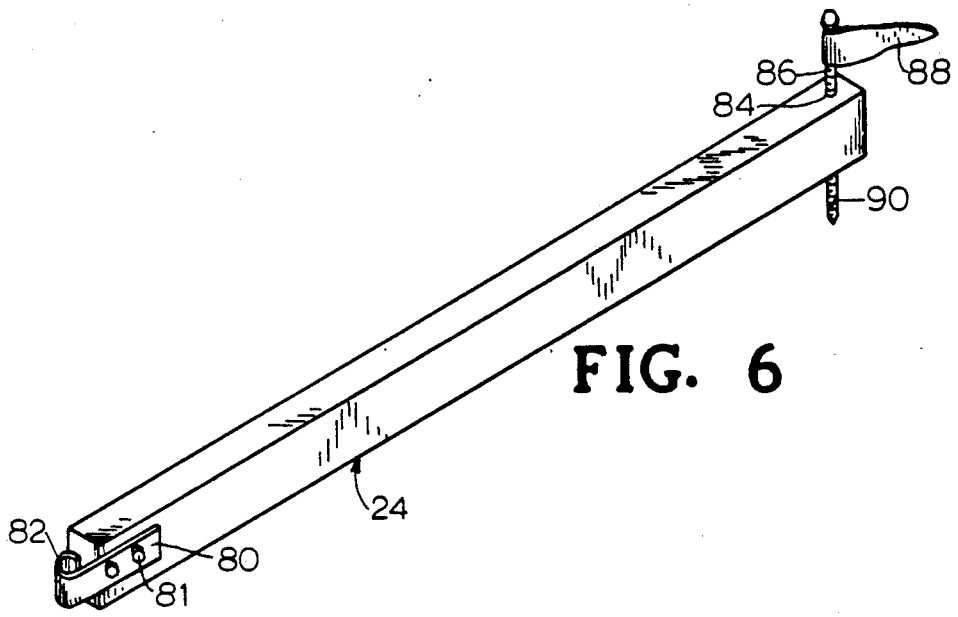
FIG. 6 is a perspective view of the top and a first side of the barrier piece.
Figure 7:
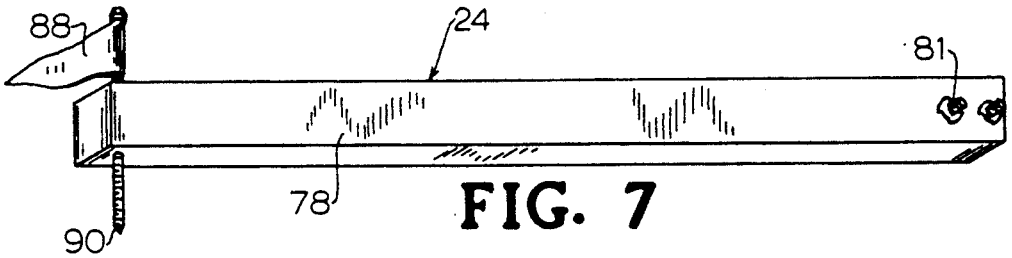
FIG. 7 is a perspective view of the bottom and a second side of the barrier piece.

The barrier pieces 24 (FIGS. 6–7) comprise an elongated rectangular block 78. The block 78 may be made of wood or other sturdy substance, and preferably is made of styrofoam or wood. Generally, a block 78 of a barrier piece 24 which is about $24\times3\times2$ inches in size provides sufficient blocking of the putted balls. An anchor bracket 80 attached by means of nuts and bolts 81 at one end of the barrier piece 24 has a curved portion 82 extending beyond the block 78. A hole 84 is made in the opposite end of each block 78 for insertion of a bolt 86, nail, large screw or similar linear object. The bolt 86 serves to bear flag 88, as well as a means of grasping the end of the barrier piece 24 and its bottom tip 90 functions to keep the barrier piece 24 from moving, due to friction with a carpet or floor surface, or to the insertion of the tip 90 into the ground outside. Even if the bolt 86 is pulled up in the barrier piece 24 so that the tip does not protrude, the bolt 86 also functions to weigh the end of barrier piece 24 down. Although two barrier pieces 24 at each end of the mat 20 are preferred, additional barrier pieces (not shown) may extend along and outside of the mat in areas where it is important that the ball not wander too far afield.

The game pieces are set up as follows: A relatively level, flat location is chosen indoors or outdoors for playing the game. The location is preferably at least about $3\times16$ feet in size. The mat 20, which during storage may be rolled up around one of the end strips 26, is unrolled lengthwise at the chosen site. A goal cup 22 is aligned at each end of the mat 20 between the cup location lines 36 at each end of the mat, with the opening 92 of each cup 22 facing the other end of the mat.

Figure 8:
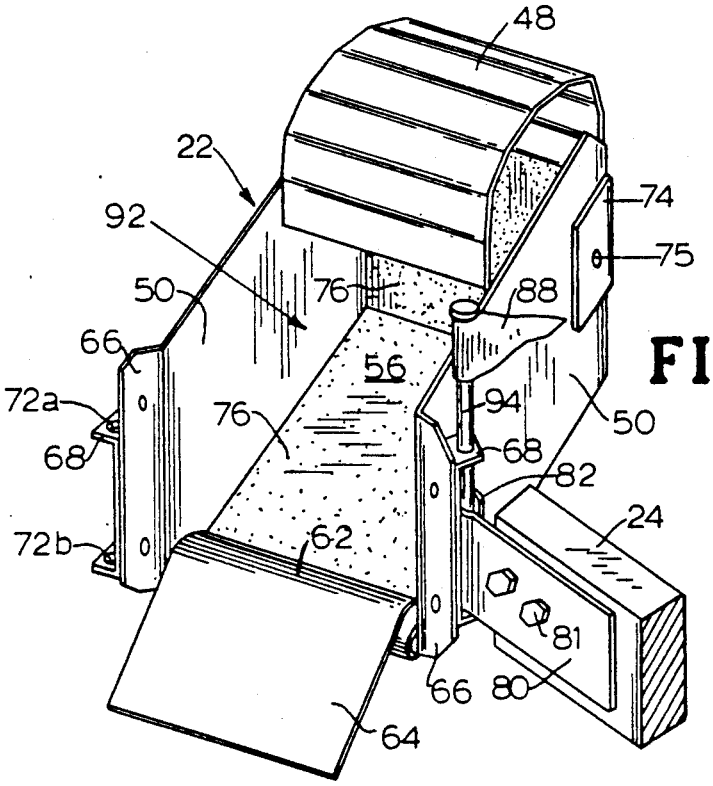
FIG. 8 is a perspective view of the area of attachment of a barrier piece of the invention to the goal cup as viewed from the open side of the cup.
Figure 9:
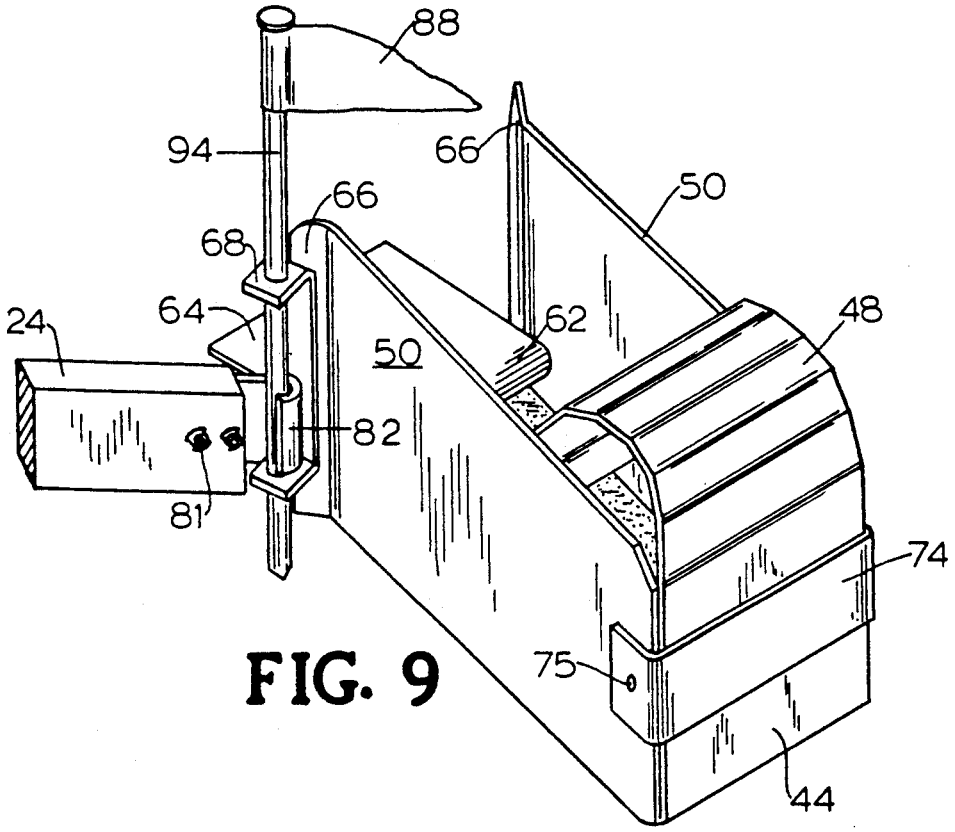
FIG. 9 is a perspective view of the area of attachment of a barrier piece of the invention to the goal cup as viewed at the back side of the cup outside the cup.

A barrier piece 24 is placed at the side of each goal cup 22 with the anchor bracket 80 being near the anchor piece 68 and the remainder of the barrier piece 24 angled so that the two barrier pieces 24 form a "V" with the goal cup 22 at the vertex and bolt end of the barrier pieces extending outward and toward the other end of the mat. An anchoring bolt 94 is placed through the upper hole 72*a* of the anchor piece 68, the curved portion of the anchor bracket 82 on the barrier piece 24, and the lower hole 72*b* of the anchor piece 68 to hold each barrier piece 24 to a goal cup 22 (FIGS. 8–9). The angle the barrier piece 24 makes with each other may be adjusted by rotating each barrier piece 24 about its anchoring bolt 94. The anchoring bolts 94 may have flags 88 at their tops to mark their location and to provide a game-playing atmosphere. When assembled, the goal cup 22 has a curved cover 48 to direct a ball that hits the back and bounces up, back downward again.

Although the game pieces may of course also be used for simple putting practice, the game of the invention is preferably played with the following rules.

When the game is played with two players, each player has a golf putter and a different color ball. Player A positions his golf ball behind the putting line 34 of the nearest cup 22 and putts the ball toward the cup 22 at the opposite end of the mat with the goal of getting the ball in the cup 22. If the ball goes into the cup 22 and stays there, Player A may score an optimum number of points, for example, five points. If the ball comes to rest within the scoring area, and on the carpet, Player A may score a lower number of points, for example, one point, if Player B does not putt his ball closer to the cup entrance.

Player B then does the same as Player A and putts from the same end as Player A did. If Player A's ball is in the cup 22 and Player B's ball also goes in the cup 22, Player B gets 5 points plus takes away Player A's 5 points for a total of 10 points. If the two players' balls are both outside the cup 22, the player whose ball is closest, and within the scoring area, gets one point. Measurements of the ball location are made from edge 66 of the cups 22. On the next turn, the player who scores has to putt first so the other player has the advantage. The ball is putted back and forth until one player has 21 points to win the game.

The game of the invention may be played by four people in teams of two, with a partner from each team remaining at each end of the mat, and not moving from cup to cup.

While the invention has been described with reference to specific embodiments thereof, it will be appreciated that numerous variations, modifications, and embodiments are possible, and accordingly, all such variations, modifications, and embodiments are to be regarded as being within the spirit and scope of the invention.

What is claimed is:

1. A golf game apparatus to be played with a golf club and ball, comprising:

(a) a linear mat having a first and a second end;

(b) a plurality of goal cups, each goal cup having generally rectangular sides, said goal cups positioned at each of said ends, each of said goal cups having an opening facing the other goal cup, each of said goal cups comprising:

(i) two sides;

(ii) a lower floor;

(iii) a curved upper cover; and (iv) a back side;

(c) a plurality of barrier pieces, said barrier pieces attached to the sides of each goal cup to prevent the ball from rolling away from said mat;

(d) a putting line located at each end between the goal cups; and (e) a scoring line at each end, said scoring line, barrier pieces and goal cup defining a scoring area at each end.

2. A golf game according to claim 1, wherein the linear mat is about 16 feet by 27 inches in size.

3. A golf game according to claim 1, wherein the linear mat is made of grass-simulating carpet material.

4. A golf game according to claim 1, wherein the sides, floor, cover and back are made in on piece.

5. A golf game according to claim 1, wherein cushioning material is placed on the floor and on the back side inside the goal cup.

6. A golf game according to claim 1, further comprising a sturdy strip of material attached to each end of the mat, said strips each having holes for placement of spikes to hold the mat to the ground.

7. A golf game according to claim 1, wherein the barrier pieces are made of a material selected from the group consisting of styrofoam and wood.

8. A golf game according to claim 1, further comprising a plurality of golf clubs and a plurality of golf balls.

* * * * *